US011174114B2

(12) United States Patent
Miles

(10) Patent No.: US 11,174,114 B2
(45) Date of Patent: Nov. 16, 2021

(54) CLAMPS

(71) Applicant: Hewlett-Packard Development Company, L.P., Houston, TX (US)

(72) Inventor: Michael D Miles, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 573 days.

(21) Appl. No.: 16/093,482

(22) PCT Filed: Aug. 18, 2016

(86) PCT No.: PCT/US2016/047571

§ 371 (c)(1),
(2) Date: Oct. 12, 2018

(87) PCT Pub. No.: WO2018/034666

PCT Pub. Date: Feb. 22, 2018

(65) Prior Publication Data

US 2021/0214177 A1 Jul. 15, 2021

(51) Int. Cl.

| | |
|---|---|
| ***B65H 5/14*** | (2006.01) |
| ***B65H 5/08*** | (2006.01) |
| ***B65H 29/04*** | (2006.01) |

(52) U.S. Cl.

CPC ..... *B65H 5/14* (2013.01); *B65H 5/085* (2013.01); *B65H 29/04* (2013.01); *B65H 29/045* (2013.01);

(Continued)

(58) Field of Classification Search

CPC . B65H 5/00; B65H 5/08; B65H 5/085; B65H 5/12; B65H 5/14; B65H 29/04; B65H 29/045; B65H 29/047; B65H 29/048; B65H 2404/144; B65H 2404/1441; B65H 2405/58; B65H 2405/581; B65H 2405/5812; B65H 2402/5155

See application file for complete search history.

(56) References Cited

U.S. PATENT DOCUMENTS 3,637,202 A * 1/1972 Mowry ..... B41F 21/10 271/277

4,444,522 A 4/1984 Suzuki et al.

(Continued)

FOREIGN PATENT DOCUMENTS

CN 1923649 A 3/2007
CN 1923649 A 3/2007

(Continued)

OTHER PUBLICATIONS

Artem Kulachenko, Mechanics of Paper Webs in Printing Press Applications, 2006, https://www.diva-portal.org/ ~ 24 pages.

*Primary Examiner* — Prasad V Gokhale

(74) *Attorney, Agent, or Firm* — HP Inc. Patent Department

(57) ABSTRACT

In an example, a clamp may include a roller disposed on a swingarm, a slide disposed on the swingarm that may apply friction against the roller in a first position and in a second position, a cam to engage with the slide, and a latch to retain the slide in the second position. The slide may move from the first position to the second position as the slide moves along the cam, and the slide may apply a greater friction against the roller in the second position than in the first position.

15 Claims, 6 Drawing Sheets

(52) U.S. Cl.
CPC ..... *B65H 2402/5155* (2013.01); *B65H 2402/543* (2013.01); *B65H 2404/144* (2013.01); *B65H 2405/5812* (2013.01)

(56) References Cited

U.S. PATENT DOCUMENTS

| | | | | |
|---|---|---|---|---|
| 4,465,390 | A | 8/1984 | Zander | |
| 5,179,900 | A * | 1/1993 | Schwitzky | B65H 29/041 101/240 |
| 6,032,952 | A | 3/2000 | Walsh | |
| 6,230,954 | B1 | 5/2001 | Ito et al. | |
| 9,079,742 | B2 | 7/2015 | Blanchard et al. | |
| 9,205,680 | B2 | 12/2015 | Mackey et al. | |
| 9,321,603 | B1 * | 4/2016 | Nakamura | G03G 15/2064 |
| 2007/0069456 | A1 * | 3/2007 | Jeong | B65H 9/106 271/272 |
| 2008/0006990 | A1 | 1/2008 | Guaraldi et al. | |
| 2008/0042340 | A1 * | 2/2008 | Linder | B65H 5/062 271/274 |
| 2010/0072697 | A1 | 3/2010 | Sokolowski | |
| 2014/0232778 | A1 | 8/2014 | Edwards et al. | |
| 2016/0136980 | A1 | 5/2016 | Kobayashi et al. | |

FOREIGN PATENT DOCUMENTS

| | | | |
|---|---|---|---|
| CN | 101178567 | A | 5/2008 |
| CN | 101178567 | A | 5/2008 |
| CN | 101274545 | | 10/2008 |
| CN | 101489899 | | 7/2009 |
| CN | 102424293 | A | 4/2012 |
| CN | 102424293 | A | 4/2012 |
| CN | 102502354 | A | 6/2012 |
| CN | 102502354 | A | 6/2012 |
| CN | 102815099 | A | 12/2012 |
| CN | 102815099 | A | 12/2012 |
| CN | 104070847 | A | 10/2014 |
| CN | 104070847 | A | 10/2014 |
| CN | 104609221 | A | 5/2015 |
| CN | 104609221 | A | 5/2015 |
| CN | 104838430 | A | 8/2015 |
| CN | 104838430 | A | 8/2015 |
| EP | 1974938 | | 10/2008 |
| EP | 2743221 | | 6/2014 |
| JP | 2010228324 | A | 10/2010 |
| JP | 2010228324 | A | 10/2010 |
| JP | 2012041097 | A | 3/2012 |
| JP | 2012041097 | A | 3/2012 |
| RU | 2070113 | C1 | 12/1996 |

* cited by examiner

CLAMPS

BACKGROUND

Imaging devices may perform actions on or with media imaging devices may print, scan, copy, or perform other actions on or with the media. Further, imaging devices may transport media throughout the imaging device, into or out of the imaging device, or from a first imaging device to a second imaging device Imaging devices may transport media of different sizes, thicknesses, or materials.

DETAILED DESCRIPTION

Figure 1A:
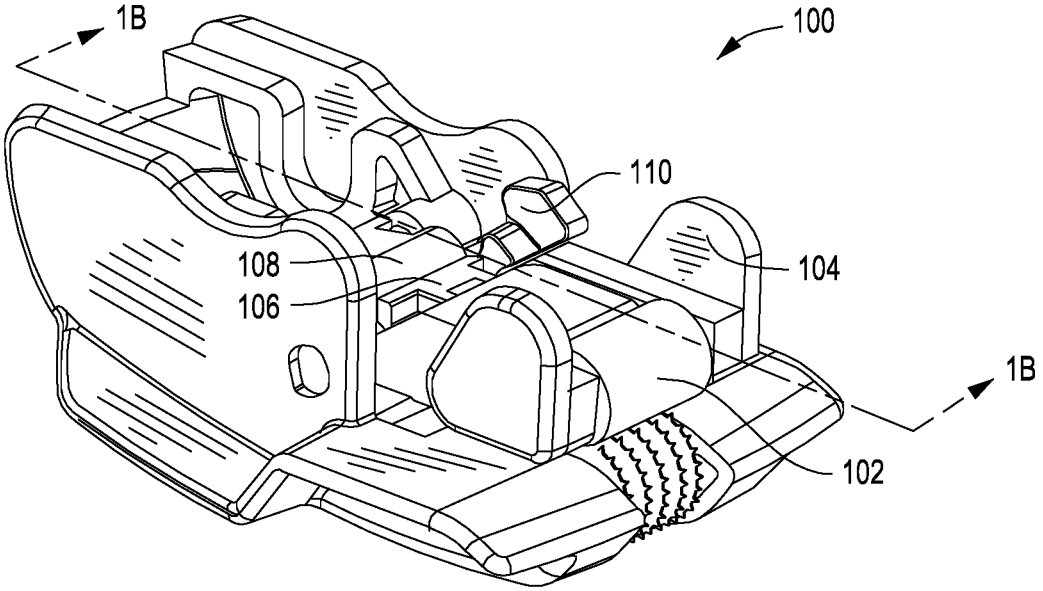
FIG. 1A is a perspective view of an example clamp.

Imaging devices may perform actions on or with a medium or media. Imaging devices may print, scan, copy, or perform other actions or imaging operations on or with media. In some situations, imaging devices may perform an imaging operation in one portion of the imaging device, then transport media to another portion of the imaging device wherein the imaging device may perform another action on or with the media. As such, imaging devices may transport media throughout the imaging device, into or out of the imaging device, or from a first imaging device to a second imaging device. In some situations, it may be desirable to transport media without damaging the media, and or without altering or affecting the quality of an imaging operation performed thereon.

In some situations an imaging device may transport different types of media, or media having different characteristics, such as different thickness, size, and/or material. Further, the imaging device may transport media after an imaging operation, such as printing for example, has been performed on or with the media. As such, the imaging device may transport media that has a varying weight and/or surface dryness, and, thus, a varying frictional resistance when transported over surfaces within the imaging device, or other sheets or pieces of media. Therefore, it may be desirable for the imaging device to have a clamp and/or media transporter, or another mechanism, to transport media having a range of weight or frictional resistance without damaging the media, or otherwise affecting an imaging operation performed thereon.

In some situations, imaging devices may include a mechanism to transport media that has a constant retaining force or clamping force. In such a situation, the constant retaining force may be sufficient to retain and transport media of a relatively lighter weight and or a lower frictional resistance without damaging the media, but may be insufficiently strong enough to transport media having a heavier weight, and or higher frictional resistance. In other situations, the constant retaining force may be strong enough to retain and transport media of a heavier weight, but may damage thinner media or media of a lighter weight upon the media being pulled or pushed out of the retaining mechanism at the end of the transporting of the media. Thus, in some situations, it may be desirable for the imaging device to have a media transporter with a variable retaining or clamping force, such that the imaging device may transport media of varying weight without damaging the media.

Implementations of the present disclosure provide clamps having a variable clamping force for transporting a medium or media within or between imaging devices without damaging the medium or media. Medium may refer to a singular piece or portion of media Examples of clamps described herein may retain and transport media throughout a media transport path and enable to media to he removed from the clamp at the end of the media transport path without damaging the media. Further, in some implementations, examples of clamps described herein may retain and transport media with a retaining or clamping force, and may lower the retaining or clamping force before or upon reaching the end of the media transport path such that the media may more easily be removed from the clamp so as to avoid damaging the media upon the media being removed from the clamp.

Referring now to FIG. 1A, a perspective view of an example clamp 100 of an imaging device is illustrated. The imaging device may be a printer, scanner, copier, plotter, or another imaging device or a portion thereof, in some implementations. In further implementations, the imaging device may refer to a component or system engaged with an imaging device, such as a post-processing system, a conditioning system, or a finishing system, or a portion thereof or therebetween.

Figure 1B:
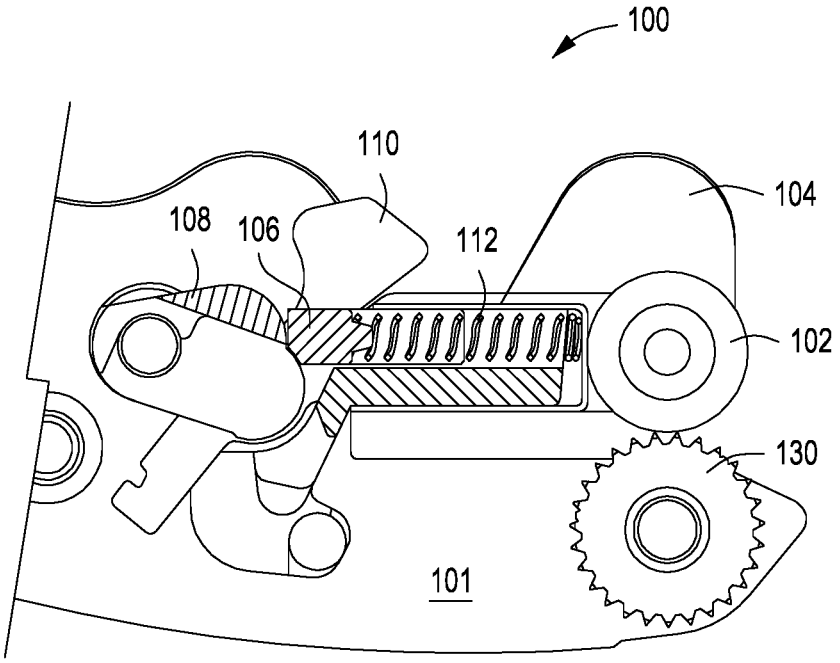
FIG. 1B is a side cross-sectional view of an example clamp.

Clamp 100, in some implementations, may be referred to as a media clamp. The example clamp 100 may include a roller 102, a swingarm 104, a slide 106, a cam 108, and a latch 110. Referring additionally to FIG. 1B, a cross-sectional view of the example clamp 100 is illustrated, wherein the cross-section may be taken along a line similar to line 1B-1B of FIG. 1A. The roller 102 may be a cylindrical component to engage with media, in some implementations. In other implementations, the roller 102 may have a different shape or geometry. The roller 102 may be rotatably engaged with or otherwise disposed on the swingarm 104 so as to engage with media disposed underneath the swingarm when the clamp 100 is engaged with media in some implementations, the roller 102 may be arranged to pinch or clamp media, or otherwise retain media against another media engagement component 130. In some implementations, the other media engagement component 130 may be a second roller, a friction surface, or another surface against which the roller 102 may clamp media.

The swingarm 104 may he a rigid or semi-rigid pivoting arm or member that may be rotatable relative to a body 101 of the clamp 100. In some implementations, the swingarm 104 may be able to transition, pivot or swing, or otherwise move between or from a clamped position to an open position, and vice versa. The swingarm 104 may be illustrated as being in the clamped position in FIGS. 1A-B. When the swingarm 104 is in the clamped position, the roller 102 may retain a medium or media within the clamp 100. Conversely, when the swingarm 104 is disposed in the open position, the roller 102 may release media previously retained in the clamp 100, and/or the clamp 100 may be able to receive media to be clamped and transported. In some implementations, the roller 102 may be disposed on a distal end of the swingarm 104, the distal end being an end opposite to or away from a pivot end of the swingarm 104, such that the roller 102 pivots or rotates with the swingarm 104 relative to the body 101. The slide 106 may also be disposed on the swingarm 104, in some implementations. In further implementations, the slide 106 may be disposed in between the pivot end and the distal end of the swingarm 104, and, further, may be slidable relative to the swingarm The slide 106 may be slidable along the length of the swingarm 104, or a portion thereof. The slide 106, in some implementations, may be movable or slidable from a first position to a second position along the length of the swingarm 104. The slide 106 may be illustrated as being in the first position in FIG. 1B. In further implementations, the slide 106 may be disposed on the swingarm 104 such that the slide 106 pivots with or travels with the swingarm 104, relative to the body 101. The slide 106 may apply force against the roller 102 so as to inhibit, diminish, or retard the ability of the roller 102 to rotate relative to the swingarm 104 In other words, the slide 106 may apply friction to the roller 102 to increase a pullout force necessary to remove media from engagement with the clamp 100. In some implementations, the slide 106 may adjustably apply friction against the roller 102. In further implementations, the slide 106 may apply friction against the roller 102 in the first position and in the second position, wherein the slide 106 may apply a greater friction against the roller 102 in the second position than in the first position.

In some implementations, the clamp 100 may further include a bias member 112 disposed in between the slide 106 and the roller 102. The bias member 112 may be a resilient component that may be elastically deformable. In other words, the bias member 112 may be able to return to its original shape and geometry after undergoing a deformation. Further, the bias member 112 may exert a reactive force in response to and proportional to a deformation. In some implementations, the bias member 112 may be a spring, or, more specifically, a compression spring. In other implementations, the bias member 112 may be a different type of spring. The bias member 112 may be disposed in between the slide 106 and the roller 102 such that the slide 106 may deform or compress the bias member 112 so as to cause the bias member 112 to exert a reactive force against the roller 102. Such a reactive force may exert friction upon the roller 102 to inhibit the rotation of the roller 102 relative to the swingarm 104. Such inhibition of rotation of the roller 102 may prevent media engaged with the roller 102, or retained by the roller 102 within the clamp 100, from pulling out of slipping out of, or otherwise no longer being retained by the clamp 100. Such inhibition of rotation of the roller 102, in other words, may raise the pullout force needed to remove the media. In some implementations, the slide 106 may compress or deform the bias member 112 a higher amount when in the second position than when in the first position. Therefore, the slide 106 may raise the pullout force needed to remove the media when in the second position.

The clamp 100 may further include a cam 108. The cam 108 may be fixed relative to the body 101, in some implementations. Thus, the swingarm 104, and the slide 106 and the roller 102 thereon, may be able to pivot, rotate, or otherwise move relative to the cam 108. The cam 108 may be engaged with the slide 106, or a portion thereof, so as to press the slide against the bias member 112, thereby causing a compression or other deformation of the bias member 112 resulting in a reactive force exerted against the roller 102. In some implementations, the cam 108 may press on the slide 106 so as to compress the bias member 112 when the slide 106 is disposed in the first position to apply friction against the roller 102. In other implementations, the cam 108 may not press the slide 106 against the bias member 112 to a sufficient degree so as to compress the bias member 112, therefore not exerting friction against the roller 102 when the slide 106 is in the first position. In some implementations, the slide 106 may move along the cam 108 as the swingarm 104 moves from the clamped position to the open position. Such a movement along the cam 108 may cause the slide 106 to move from the first position to the second position, in some implementations. Thus, the cam 108 may move the slide from the first to the second position. When in the second position, the cam 108 may press the slide 106 against the bias member 112 to compress the bias member to apply friction against the roller 102. In some implementations, the slide 106 may apply a greater friction against the roller 102 in the second position than in the first position. Therefore, the cam 108 may move the slide 106 in order to adjust the friction applied to the roller 102.

The clamp 100 may further include a latch 110, in some implementations. The latch 110 may be movable relative to the body 101, and may move with the swingarm 104 relative to the body 101, in some implementations. In further implementations the latch 110 may also be pivotable relative to the swingarm 104. In yet further implementations, the latch 110 may pivot relative to the swingarm 104 to engage with the slide 106 when the swingarm 104 is disposed in the open position and the slide 106 is disposed in the second position. The latch 110 may retain or hold the slide 106 in the second position through such a pivoting movement. In other implementations, the latch 110 may pivot to retain the slide 106 in the second position when the swingarm 104 is in a different position other than the open position. In yet other implementations. the latch 110 may retain the slide 106 in a position other than the second position to which the cam 108 has moved the slide 106.

Figure 2A:
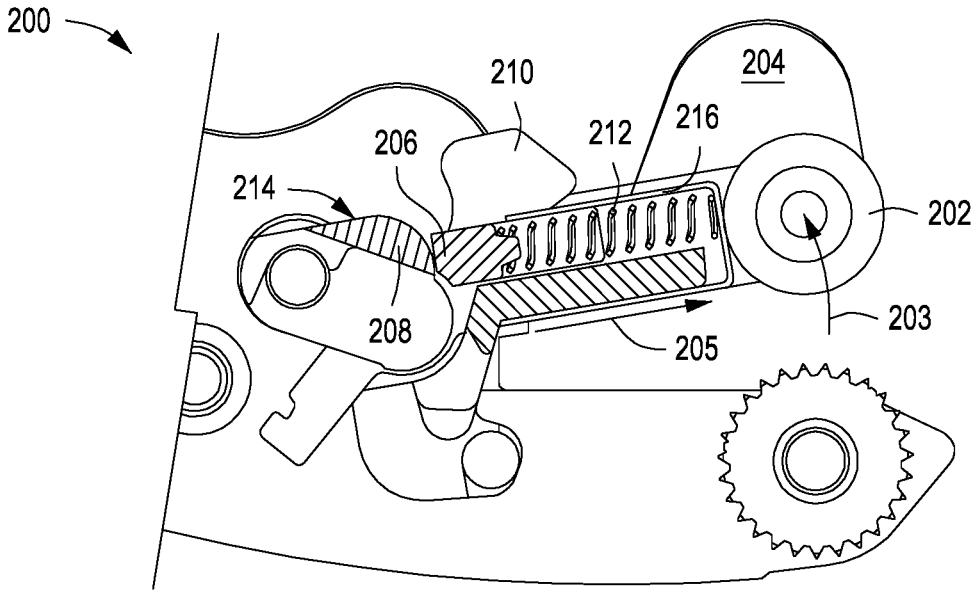
FIG. 2A is a side cross-sectional view of an example clamp.

Referring now to FIG. 2A, a side cross-sectional view of an example clamp 200 is illustrated. Example clamp 200 may be similar to example clamp 100. Further, the similarly named elements of example clamp 200 may be similar in function and/or structure to the elements of example clamp 100, as they are described above. FIG. 2A may illustrate example clamp 200 after a swingarm 204 has begun to transition from a clamped position to an open position, for example, along direction 203. Such a transition may be caused by another component of an imaging device within which the clamp 200 might be disposed. In some implementations, the clamp 200 may further include a friction plate 216, which may be disposed against a roller 202. The friction plate 216 may be a rigid or semi-rigid component disposed in between a bias member 212 and the roller 202 such that the friction plate disperses force exerted by the bias member 212 against the roller 202. In some implementations, the friction plate 216 is disposed on the swingarm 204 such that the friction plate 216 moves with the swingarm 204.

The friction plate 216 may be biased against the roller 202 by a slide 206 and the bias member 212. Thus, the slide 206 may push on, or be pushed against the bias member 212 in order to bias the friction plate 216 against the roller 202. In some implementations, the slide 206 may bias the friction plate 216 against the roller 202 when in a first position, a second position, and/or the entire transition of the slide between the first and second positions. In some implementations, the slide 206 may move from the first position to the second position along example direction 205 to push against the bias member 212. In further implementations, the slide 206 may bias the friction plate 216 a greater amount against the roller 202 when the slide 206 is disposed in the second position In yet further implementations, the slide 206 may bias the friction plate 216 against the roller 202 in a continuously increasing manner throughout the transition of the slide 206 from the first position to the second position. In other words, the slide 206 may further compress the bias member 212 against the friction plate as the slide moves along direction 205 from the first to the second position, thereby applying an increasingly greater friction against the roller 202 throughout such a transition.

In some implementations, a cam 208 of the clamp 200 may move or transition the slide 206 from the first position to the second position as the slide 206 is moved along a cam surface 214 of the cam 208 In further implementations, the movement of the swingarm 204 from the clamped position to the open position may move the slide 206 along the cam surface 214. Thus, as illustrated in FIG. 2A, the partial movement of the swingarm 204 from the clamped position towards the open position along direction 203 has caused the slide 206 to move along a portion of the cam surface 214. The cam surface 214 has, thus, started to push the slide 206 along direction 205 to compress or deform the bias member 212, thus resulting in the bias member 212 exerting a reactive force against roller 202 through the friction plate 216.

Figure 2B:
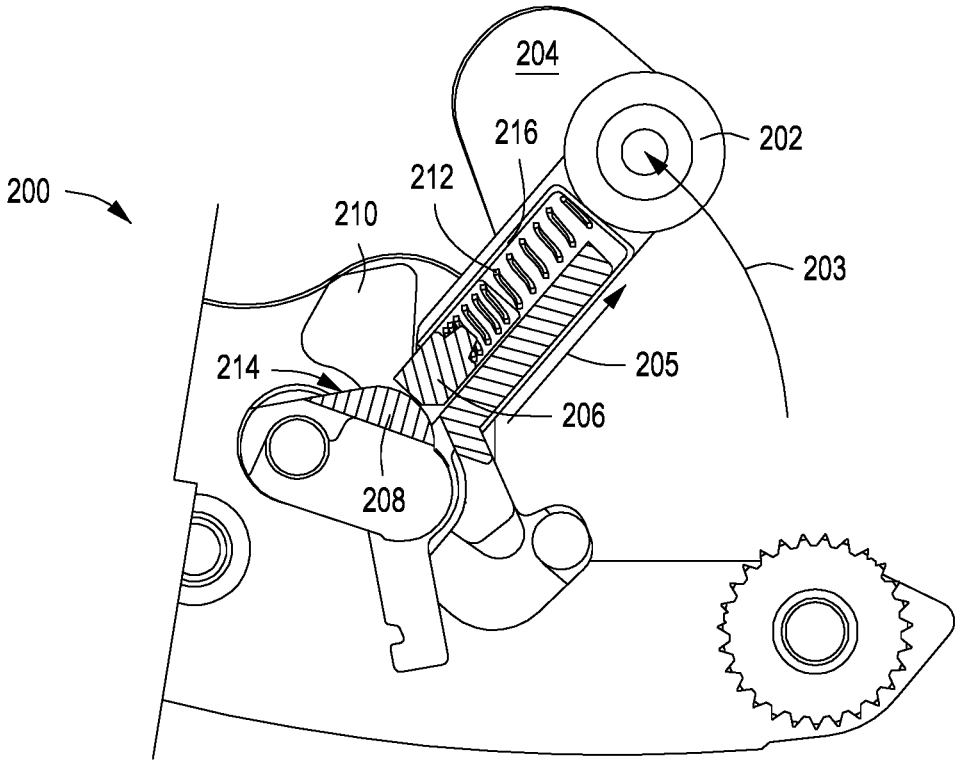
FIG. 2B is a side cross-sectional view of an example clamp.

Referring now to FIG. 2B, a side cross-sectional view of the example clamp 200 is illustrated, wherein the swingarm 204 has fully transitioned to the open position along direction 203. Throughout the travel of the swingarm 204 to the open position, the slide 206 has moved further along the cam surface 214. As such, the cam surface 214 has further pushed the slide 206 along direction 205 to the second position, thereby further compressing the bias member 212 and increasing the reactive force the bias member 212 exerts on the roller 202 through the friction plate 216. Therefore, with the slide 206 in the second position, the slide 206 may apply a greater friction against the roller 202 than when the slide is in the first position.

Figure 3A:
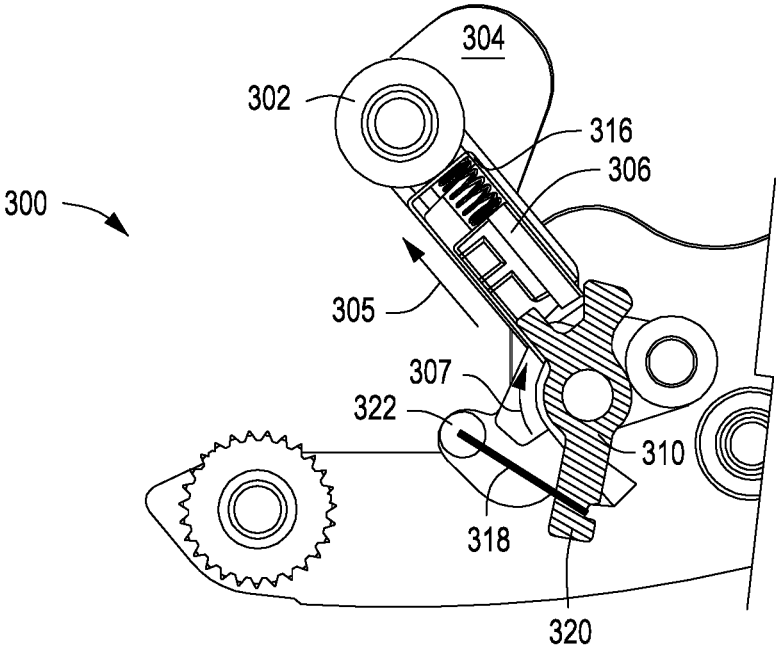
FIG. 3A is a side cross-sectional view of an example clamp.

Referring now to FIG. 3A. a side cross-sectional view of an example clamp 300 from an opposing side is illustrated. Example clamp 300 may be similar to other example clamps described above. Further, the similarly named elements of example clamp 300 may be similar in function and/or structure to the elements of other example clamps, as they are described above. FIG. 3A illustrates an example clamp 300 wherein a swingarm 304 has fully transitioned to an open position, and a slide 306 has fully transitioned along direction 305 to a second position. The slide 306 may exert a higher force or friction on a roller 302 of the clamp 300 in the illustrated position than if the slide 306 were disposed in a first position. The clamp 300 may further include a latch 310 which may be rotatable or pivotable relative to the swingarm 304. Further, the clamp 300 may include a latch bias member 318. While illustrated as just a link, the latch bias member 318 may be a resilient component, similar to above-described bias members. In further implementations, the latch bias member 318 may be a tension or extension spring. In other implementations, the latch bias member 318 may be another type of spring, or another resilient component, such as a rubber band or the like.

Figure 3B:
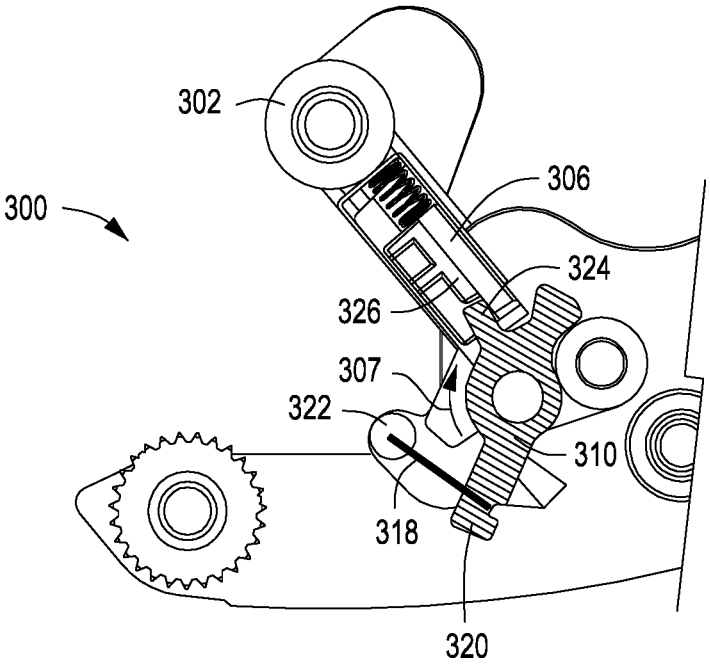
FIG. 3B is a side cross-sectional view of an example clamp.

The latch bias member 318 may be engaged with a biased end 320 of the latch 310, and also with an anchor point 322 of the swingarm 304. In some implementations, the anchor point 322 may be a separate component from the swingarm 304. The latch bias member 318 may bias the latch 310 along a direction 307, relative to the swingarm 304, towards a latched position. Referring additionally to FIG. 3B, a side cross-sectional view of example clamp 300 is illustrated wherein the latch 310 has transitioned along direction 307 to the latched position. When in the latched position, a stop 324 of the latch 310 may engage with a ledge 326 of the slide 306 such that the stop 324 prevents the bias member from pushing the slide back to the first position from the second position. In other words, the latch 310 may pivot to the latched position to retain the slide 306 in the second position. In some implementations, the swingarm 304 may begin to swing back to the clamped portion prior to the latch 310 pivoting to retain the slide 306. In such a situation, the latch may pivot to the latched position before the swingarm 304 readies the clamped position. The stop 324, and/or the ledge 326 may have complementary structures to one another such that they fit, mate, or nest together when the latch is in the latched position. Note, in some implementations, the latch bias member 318 may continuously bias the latch 310 towards the latched position, however, the latch 310 may be prevented from pivoting to the latched position until the slide has fully transitioned to the second position.

Figure 4A:
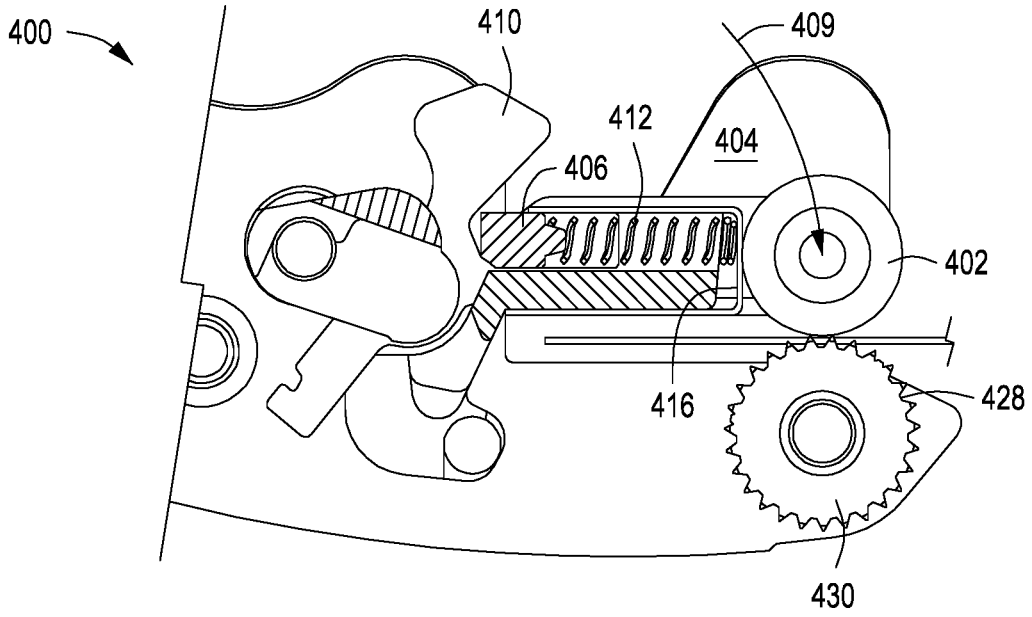
FIG. 4A is a side cross-sectional view of an example clamp.

Referring now to FIG. 4A. a side cross-sectional view of an example clamp 400 is illustrated. Example clamp 400 may be similar lo other example clamps described above. Further, the similarly named elements of example clamp 400 may be similar in function and/or structure to the elements of other example clamps, as they are described above. FIG. 4A depicts example clamp 400 after a latch 410 has transitioned to a latched position to retain a slide 406 in a second position, as similarly described regarding FIGS. 3A-B. In some implementations, after the latch 410 pivots to the latched position, a swingarm 404 may transition from an open position to a clamped position, for example, along direction 409. In other words, the swingarm 404 may swing from the open position to the clamped position after the slide 406 reaches the second position, and is retained therein. FIG. 4A illustrates the swingarm 404 as being disposed in the clamped position. In some implementations, the clamp 400 may further include a swingarm bias member to bias the swingarm 404 towards the clamped position. The latch 410 may move with the swingarm 404 to continue to hold the slide 406 in the second position. Even though the swingarm 404 is in the clamped position, the slide 406 may be retained in the second position by the latch 410, against the urging or reactive force of a bias member 412, which may bias the slide in a direction towards the first position. As such, the slide and bias member 412 may exert a greater friction on a roller 402 than if the slide was disposed in the first position. Therefore, the greater friction exerted on the roller 402 may prevent the roller 402 from rotating relative to the swingarm 404 so that the roller may pinch or clamp media 428 within the clamp 400, and the clamp 400 may transport the media 428. In some implementations, the clamp 400 may transport the media 428 within an imaging device when the swingarm 404 is in the clamped position. In some implementations, the media 428 may refer to print media, or other media that may suitable for use in an imaging device. In further implementations, the media 428 may be paper, card stock, cardboard, vinyl, latex, or another suitable media. In some implementations, the roller 402 may pinch or clamp the media 428 against another media engagement component 430, or a friction surface in order to retain the media 428.

Figure 4B:
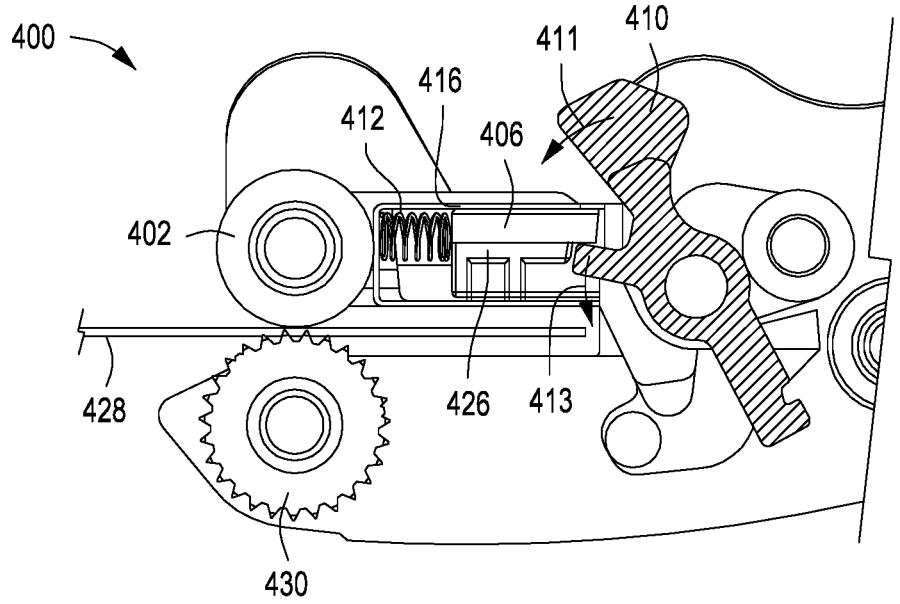
FIG. 4B is a side cross-sectional view of an example clamp.
Figure 4C:
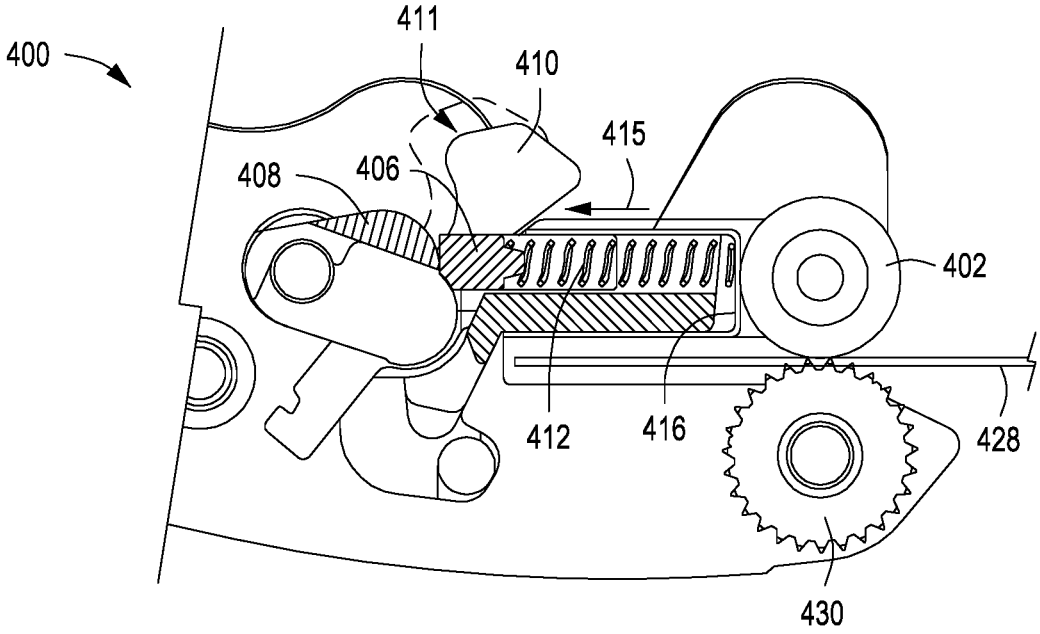
FIG. 4C is a side cross-sectional view of an example clamp.

Referring now to FIGS. 4B-C, opposing side cross-sectional views of the example clamp 400 are illustrated. FIG. 4B illustrates the example clamp 400 wherein the latch 410 is still in the latched position, while FIG. 4C illustrates the example clamp 400 wherein the latch 410 has been transitioned or pivoted out of the latched position to release the slide 406 to the first position. In some implementations, after the swingarm 404 has transitioned from the open position to the clamped position, the clamp 400 may lower the retaining or clamping force exerted on the media 428 prior to the media 428 being removed from the clamp 400. Accordingly, prior to the media 428 being removed from the clamp 400, the slide 406 may transition from the second position to the first position, thereby lowering the amount of compression or deformation experienced by the bias member 412, and lowering the resulting reactive force exerted on the roller 402. By lowering the friction exerted on the roller 402 by the reactive force of the bias member 412, the roller 402 may more easily rotate or roll relative to the swingarm 404, and the media 428 may more easily be pulled or pushed out of the clamp 400 by another component of the imaging device. In other words, the clamp 400 may lower the pullout force of the media 428 by moving the slide 406 back to the first position, thereby allowing a stationary component of the imaging device to impact the media 428 to remove the media 428 from the clamp 400 without the media 428 being damaged by the higher pullout force of the roller 402.

In order to transition the slide from the second position to the first position, the latch 410 may be pivoted out of the latched position to release the slide 406. Thus, the latch 410 may be moved along example direction 411 to disengage the latch 410 from the ledge 426 of the slide 406, for example, along direction 413. In some implementations, another component of the clamp 400, or the imaging device within which the clamp 400 may be disposed may contact a portion of the latch 410 in order to transition the latch 410 along direction 411. Once the latch 410 is disengaged from the stop 426, the bias member 412 may push the slide 406 along example direction 415 from the second position to the first position, wherein, in some implementations, the slide 406 may come back into contact with the cam 408, or the cam surface thereof. Once back in the first position, the slide 406 may no longer compress the bias member 412 to the degree it was when in the second position, and, thus, the bias member 412 may exert a lower friction against the roller 402 through the friction plate 416.

Figure 5:
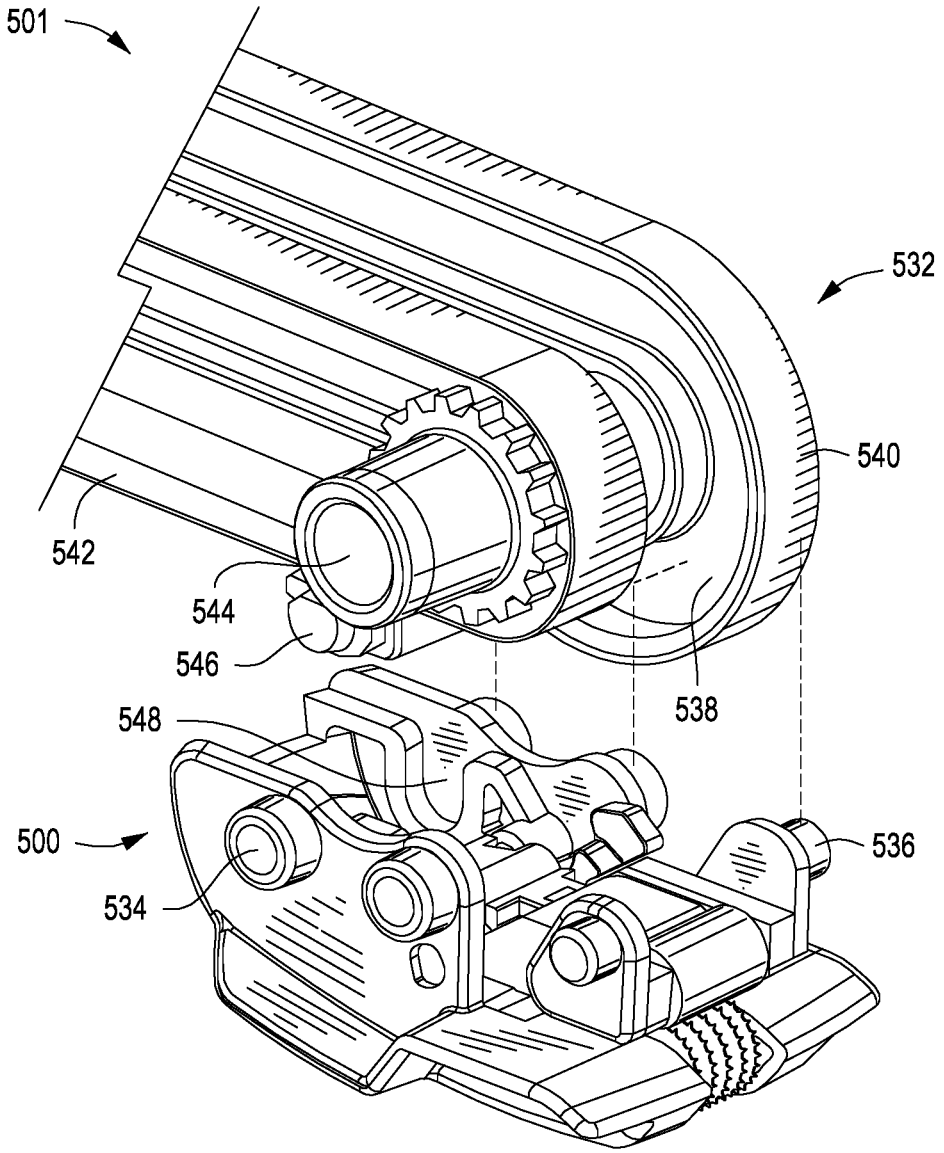
FIG. 5 is a perspective view of an example media transporter.

Referring now to FIG. 5, a perspective exploded view of an example media transporter 501 having an example clamp 500 is illustrated. Example clamp 500 may be similar to other example clamps described above. Further, the similarly named elements of example clamp 500 may be similar in function and/or stricture to the elements of other example clamps, as they are described above. The media transporter 501 may be a part of an imaging device, in some implementations. In further implementations, the media transporter 501 may be part of multiple imaging devices, and may transport media between said imaging devices. In yet further implementations, the media transporter 501 may transport media to, from, or through a device engaged with an imaging device or system, such as a post-processing device, finishing device, or a conditioning device or system.

In some implementations, the media transporter 501 may include a transport path 532, along which the clamp 500 may move or be driven to transport media. The clamp 500 may, thus, transport media along the transport path 532. In further implementations, the transport path 538 may include or be a part of, or defined by a rack 538, or another suitable component, within which the transport path may be disposed. In yet further implementations, the transport path 538 may further be defined by a second track, which may oppose the first track, such that the first and second tracks adequately support both sides of the clamp 500. In some implementations, the clamp 500 may include a guide 534 to engage with the track 538. The guide 534 may be a post, tab. or other protrusion which may extend out from a lateral side of the clamp 500, and may be sized sufficiently and have an adequate geometry to complementarily engage with the track 538. In some implementations, the guide 534 may enable the clamp 500 to be driven along the track 538. and thus, the transport path 532. In further implementations, the clamp 500 may include multiple guides 534, or enough guides 534 to enable the effective travel of the clamp 500 along the transport path. For example, in some implementations, the clamp 500 may include a guide 534 disposed on either lateral side of the clamp 500, each guide to engage with a track. In further implementations, the clamp 500 may include two or more guides 534 on each lateral side of the clamp 500, as illustrated in FIG. 5.

In some implementations, the clamp 500 may further include swingarm guides 536, which may be disposed on, or otherwise attached to a swingarm of the clamp 500. In some implementations, the clamp 500 may have just a single swingarm guide 536, or, in other implementations, the clamp 500 may have a swingarm guide 536 disposed on either side of the swingarm, as illustrated. Each swingarm guide 536 may engage with the transport path 532, or, in some implementations, may engage with an outer surface 540 of the transport path 532. Each swingarm guide 536 may travel along the outer surface 540 throughout the transmit path, or a portion thereof. In further implementations, the outer surface 540 may engage with the swingarm guides 536 in order to transition the swingarm from a clamped position to an open position, at a predetermined or desired location along the transport path. In other words, the outer surface may include a primer disposed along the transport path 532. The primer may be a protrusion, ramp, or other feature to engage with a swingarm guide 536 to move the swingarm from a clamped position to an open position. In some implementations, such movement may increase the pullout force experienced by media retained within the clamp 500.

In further implementations, the transport path 532, or a track thereof, may include a trigger disposed along the transport path 532. The trigger may contact, impact, or otherwise actuate a latch of the clamp 500 to release a slide of the clamp 500 to decrease the pullout force experienced by media retained within the clamp 500. The trigger may be located at a desired or predetermined location along the transport path such that the clamp 500 lowers the pullout force on the media at a desired point along the path.

In some implementations, the media transporter 501 may include a drive system to drive or move the clamp 500 along the transport path 532. The drive system may include a drive component 544, as well as a transmission component 542, in some implementations. The drive component 544 may be engaged with a motive element, such as a motor or other element capable of transmitting torque to the drive component 544. The transmission component 542, in some implementations, may be a component capable of transmitting movement from the drive component 544 to the clamp 500. In some implementations, the drive component 544 may be a wheel or cog, and the transmission component 542 may be a transport belt, chain, or other suitable component. In further implementations the transmission component 542 may include a drive lug 546 fixed to the transmission component 542. The drive lug 546 may be a protrusion or other suitable feature engaged with the transmission component 542 such that the drive lug 546 moves with the transmission component 542. In further implementations, the drive lug 546 may engage with a drive receptacle 548 within or attached to the clamp 500. The drive lug 546 may move with the transmission component 542 and transfer such movement to the clamp 500. In other words, the transmission component 542, through the drive lug 546 may push the example clamp 500 around or along the transport path 532. In further implementations, the clamp 500 may move along the transport path 552 by a transport belt.

What is claimed is:

1. A clamp, comprising:

a roller disposed on a swingarm;

a slide disposed on the swingarm to apply friction against the roller in a first position and in a second position, the slide to apply a greater friction against the roller in the second position than in the first position;

a cam to engage with the slide, the slide to move from the first position to the second position as the slide moves along the cam; and a latch to retain the slide in the second position.

2. The clamp of claim 1, wherein the swingarm is to swing from a clamped position to an open position, the slide to move along the cam to move the slide from the first position to the second position as the swingarm swings to the open position.

3. The clamp of claim 2, wherein the slide is to apply an increasingly greater friction against the roller as the slide moves along the cam throughout the transition of the swingarm from the clamped position to the open position.

4. The clamp of claim 2, further comprising a swingarm bias member to bias the swingarm towards the clamped position.

5. The clamp of claim 2, wherein the swingarm is to swing from the open position to the clamped position after the slide reaches the second position.

6. The clamp of claim 5, wherein the latch is to pivot to a latched position to retain the slide in the second position before the swingarm reaches the clamped position.

7. The clamp of claim 6, wherein the latch is to pivot to release the slide to the first position after the swingarm reaches the clamped position.

8. The clamp of claim 7, further comprising a latch bias member to bias the latch towards the latched position.

9. A media clamp, comprising:

a swingarm to transition between a clamped position and an open position;

a roller disposed on the swingarm, the roller to retain a medium within the clamp when the swingarm is in the clamped position;

a slide movable between a first position and second position, the slide to bias a friction plate against the roller in the first position, and to bias the friction plate against the roller in the second position such that the friction plate applies a greater friction against the roller in the second position than in the first position;

a cam to move the slide from the first position to the second position; and a latch to hold the slide in the second position, and to release the slide to the first position.

10. The media clamp of claim 9, wherein the slide is to compress a bias member against the friction plate as the slide moves from the first position to the second position.

11. The media clamp of claim 9, wherein the clamp is to transport a medium within an imaging device when the swingarm is in the clamped position.

12. A media transporter, comprising:

a transport path; and a clamp to transport a medium along the transport path, comprising:

a movable swingarm;

a roller disposed on the swingarm to engage with the medium and retain the medium against a friction surface when the swingarm is disposed in a clamped position;

a slide to adjustably apply friction against the roller;

a cam to move the slide to adjust the friction applied to the roller; and a latch to retain the slide in a position to which the cam has moved the slide.

13. The media transporter of claim 12, wherein the swingarm is movable to move the slide along the cam to increase the friction that the slide applies against the roller.

14. The media transporter of claim 13, wherein the swingarm is movable to release the slide to decrease the friction that the slide applies against the roller.

15. The media transporter of claim 12, wherein the clamp is to move along the transport path by a transport belt.

* * * * *